US008734598B2

(12) United States Patent
Yakabe et al.

(10) Patent No.: US 8,734,598 B2
(45) Date of Patent: May 27, 2014

(54) ALUMINUM SURFACE TREATMENT PROCESS AND ALUMINUM COMPOSITE MATERIAL

(75) Inventors: Fumiya Yakabe, Fuji (JP); Yoshio Jimbo, Hiratsuka (JP); Kanji Ueno, Yokohama (JP); Hideyuki Kuwahara, Kyoto (JP)

(73) Assignee: Jatco Ltd, Fuji-shi (JP)

( * ) Notice: Subject to any disclaimer, the term of this patent is extended or adjusted under 35 U.S.C. 154(b) by 686 days.

(21) Appl. No.: 12/007,878

(22) Filed: Jan. 16, 2008

(65) Prior Publication Data

US 2008/0169049 A1 Jul. 17, 2008

(30) Foreign Application Priority Data

Jan. 17, 2007 (JP) ..... 2007-008113

(51) Int. Cl.
*C23C 8/36* (2006.01)

(52) U.S. Cl.
USPC ..... 148/222; 148/238

(58) Field of Classification Search
USPC ..... 75/10.1, 10.19, 10.21; 148/210, 212, 148/222, 223, 238, 239, 516, 523, 525, 317, 148/437–440, 900; 427/523–535, 569–579, 427/294, 295, 299, 307, 309, 327
IPC ..... C23C 14/02,14/06, 14/48, 8/02, 8/36
See application file for complete search history.

(56) References Cited

U.S. PATENT DOCUMENTS

| | | | | |
|---|---|---|---|---|
| 4,597,808 | A | 7/1986 | Tachikawa et al. | |
| 4,909,862 | A * | 3/1990 | Tachikawa et al. | 148/222 |
| 5,272,015 | A * | 12/1993 | Hamdi et al. | 428/472 |
| 2007/0009661 | A1 | 1/2007 | Aizawa et al. | |

FOREIGN PATENT DOCUMENTS

| | | | |
|---|---|---|---|
| EP | 0 346 931 | A2 | 12/1989 |
| EP | 1 176 223 | A1 | 1/2002 |
| EP | 1 179 609 | A1 | 2/2002 |
| JP | 60-211061 | A | 10/1985 |
| JP | 5-179420 | A | 7/1993 |
| WO | WO 2004/065653 | A1 | 8/2004 |
| WO | WO 2008/086130 | A2 | 7/2008 |

OTHER PUBLICATIONS

H.-Y. Chen, H.-R. Stock, and P. Mayr, "Plasma-assisted nitriding of aluminum," Surface and Coatings Technology, 64 (1994), pp. 139-147.*

"Aluminum 6063," Alloy Digest, Engineering Alloys Digest (Aug. 1956, revised Jan. 1974), ASM International, 2002.*

M. Moradshahi, T. Tavakoli, S. Amiri, and Sh. Shayeganmehr, "Plasma nitriding of Al alloys by DC glow discharge," Surface and Coatings Technology, 201 (2006), pp. 567-574.*

P. Visuttipitukul, T. Aizawa, and H. Kuwahara, "Advanced Plasma Nitriding for Aluminum and Aluminum Alloys," Materials Transactions, vol. 44, No. 12 (2003), pp. 2695-2700.*

(Continued)

*Primary Examiner* — Roy King
*Assistant Examiner* — Vanessa Luk
(74) *Attorney, Agent, or Firm* — Foley & Lardner LLP

(57) ABSTRACT

There is provided an aluminum surface treatment process, comprising: preparing an aluminum material containing silicon and magnesium; and plasma nitriding the aluminum material to form an aluminum nitride region on a surface of the aluminum material.

5 Claims, 7 Drawing Sheets

(56) References Cited

OTHER PUBLICATIONS

J. Musil, J. Vlcek, and M. Ruzicka, "Recent progress in plasma nitriding," Vacuum, 59 (2000), pp. 940-951.*

S. Gredelj, A.R. Gerson, S. Kumar, and G.P. Cavallaro, "Inductively coupled plasma nitriding of aluminum," Applied Surface Science, 199 (2002), pp. 183-194.*

James J. McNally, "Ion Preclean of Substrates," Handbook of Plasma Processing Technology: Fundamentals, Etching, Deposition, and Surface Interactions, Noyes Publications, 1990, pp. 469-471.*

International Designation System for Wrought Aluminum and Wrought Aluminum Alloys, pp. 966-975, (date unknown, not provided by Applicant).

Preprints of National Meeting of Japan Welding Society, No. 19, 1976, pp. 368-369.

* cited by examiner

ALUMINUM SURFACE TREATMENT PROCESS AND ALUMINUM COMPOSITE MATERIAL

BACKGROUND OF THE INVENTION

The present invention relates to an aluminum surface treatment process and an aluminum composite material having an aluminum nitride surface region formed by the aluminum surface treatment process.

Aluminum nitride (AlN) is known for its good thermal conduction and electrical insulation capabilities and high durability such as resistance to heat, corrosion, wear, impact, crack etc. and compressive stress relaxation ability. Various treatment processes have been thus proposed to produce aluminum composite materials with aluminum nitride surface regions (layers) for improvements in material surface properties.

Japanese Laid-Open Patent Publication No. 60-211061 (abbreviated as "JP60-211061A") discloses an aluminum composite production process that includes the steps of activating a surface of an aluminum material and ion nitriding the activated surface of the aluminum material by glow discharge so as to form a coating layer of aluminum nitride on the aluminum material. In JP60-211061A, however, the aluminum nitride layer has a thickness of the order of several micrometers, at most, over ten micrometers and cannot be controlled to a sufficient thickness. It takes long time e.g. more than 24 hours to form the aluminum nitride layer even with such a small thickness during the ion nitriding. The aluminum nitride layer also lacks in homogeneity. The resulting aluminum composite material thus fails to attain sufficient durability and increases in process cost. Further, the aluminum nitride layer does not show good adhesion to the aluminum material so that it is likely that the aluminum nitride layer will become separated from the aluminum material.

Japanese Laid-Open Patent Publication No. 5-179420 (abbreviated as "JP5-179420A") discloses an aluminum composite production process that includes the steps of forming an intermediate layer of Al—Ag metal compound on an aluminum material and forming an aluminum nitride layer on the intermediate metal compound layer. In JP5-179420A, the aluminum nitride layer increases in thickness, homogeneity, durability and adhesion to the aluminum material. It is however likely that the aluminum nitride layer will become cracked when the thickness of the aluminum nitride layer exceeds 10 μm. In addition, the use of Ag in the intermediate metal compound layer and the preparation of the intermediate metal compound layer in thin-film form are essential to the aluminum composite production process. The resulting aluminum composite material thus increases in material and process cost. Moreover, the flexibility of mechanical strength of the aluminum composite material becomes poor as the strength of adhesion between the aluminum material and the aluminum nitride layer depends on the intermediate metal compound layer.

International Patent Publication No. WO2004/065653 discloses an aluminum composite production process that includes the steps of preparing a $CuAl_2$-containing aluminum material and plasma nitriding the aluminum material so as to form an aluminum nitride layer on the aluminum material. In WO2004/065653, the aluminum nitride layer can be formed with a relatively large thickness and some degree of homogeneity, durability and adhesion to the aluminum material.

SUMMARY OF THE INVENTION

There arises a need to further increase the durability of the aluminum nitride layer so as to secure higher hardness for higher wear resistance and higher toughness for higher impact resistance. However, the hardness and the toughness are traded off against each other. It is difficult to impart both of high hardness and toughness, i.e., high wear and impact resistance to the aluminum nitride layer for further improvements in material surface properties.

It is therefore an object of the present invention to provide an aluminum composite material having an aluminum nitride surface region with high wear and impact resistance and an aluminum surface treatment process for production of the aluminum composite material.

As a result of extensive researches, it has been found by the present inventors that the addition of a certain amount of silicon (Si) and magnesium (Mg) to an aluminum material is effective in nitriding the aluminum material to form an aluminum nitride (AlN) surface region with a sufficient thickness in a short time. The thus-formed aluminum nitride region has a composite structure of columnar and granular structure units linked (polymerized) together so as to attain both of hardness and toughness for high wear and impact resistance and show good adhesion to the aluminum material. The present invention is based on the above findings.

According to a first aspect of the present invention, there is provided an aluminum surface treatment process, comprising: preparing an aluminum material containing silicon and magnesium; and plasma nitriding the aluminum material to form an aluminum nitride region on a surface of the aluminum material.

According to a second aspect of the present invention, there is provided an aluminum composite material comprising a surface region formed of aluminum nitride, wherein the aluminum nitride surface region has a composite structure of columnar and granular structure units linked together.

According to a third aspect of the present invention, there is provided an aluminum composite material comprising a surface region formed of aluminum nitride, wherein silicon and magnesium are finely dispersed in the aluminum nitride surface region.

The other objects and features of the present invention will also become understood from the following description.

DESCRIPTIONS OF THE EMBODIMENTS

The present invention will be described in detail below with reference to the drawings.

First Embodiment

Figure 2:
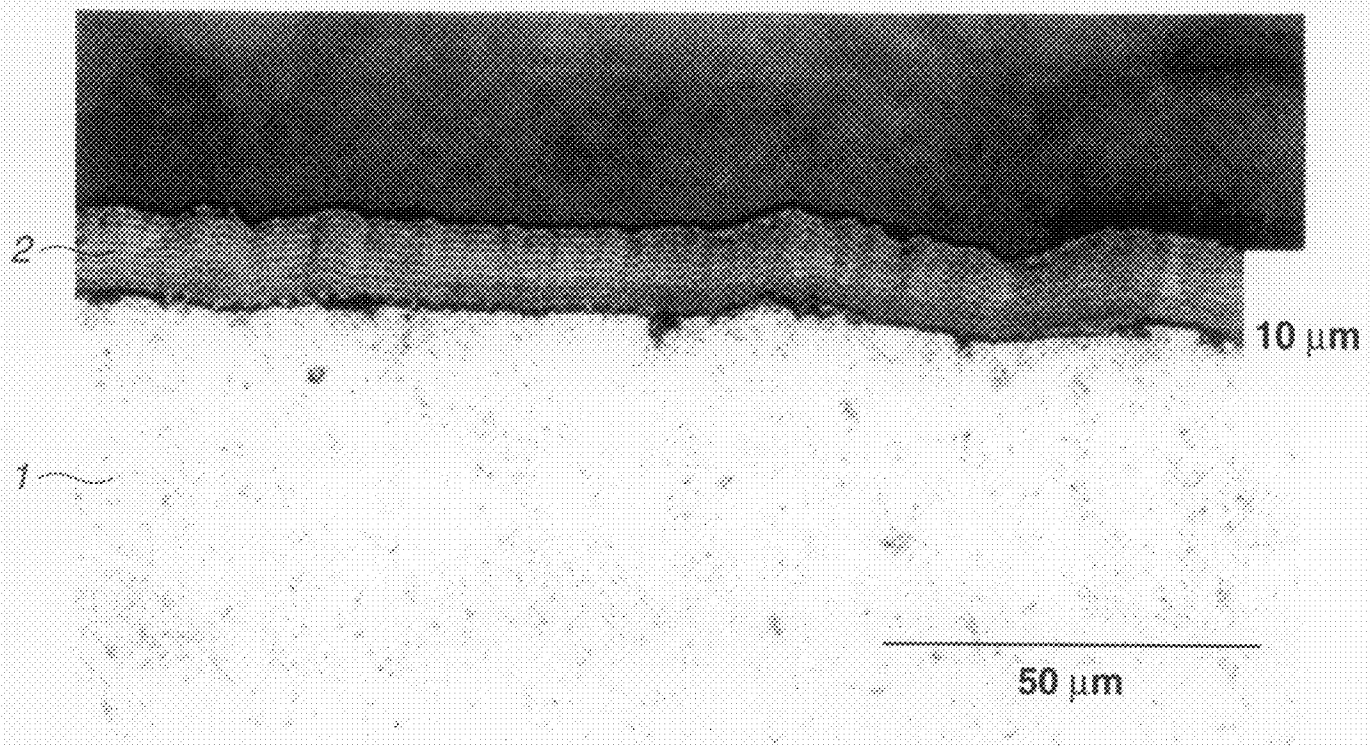
FIG. 2 is an electron micrograph showing the cross section of the aluminum composite material according to the first embodiment of the present invention.
Figure 3:
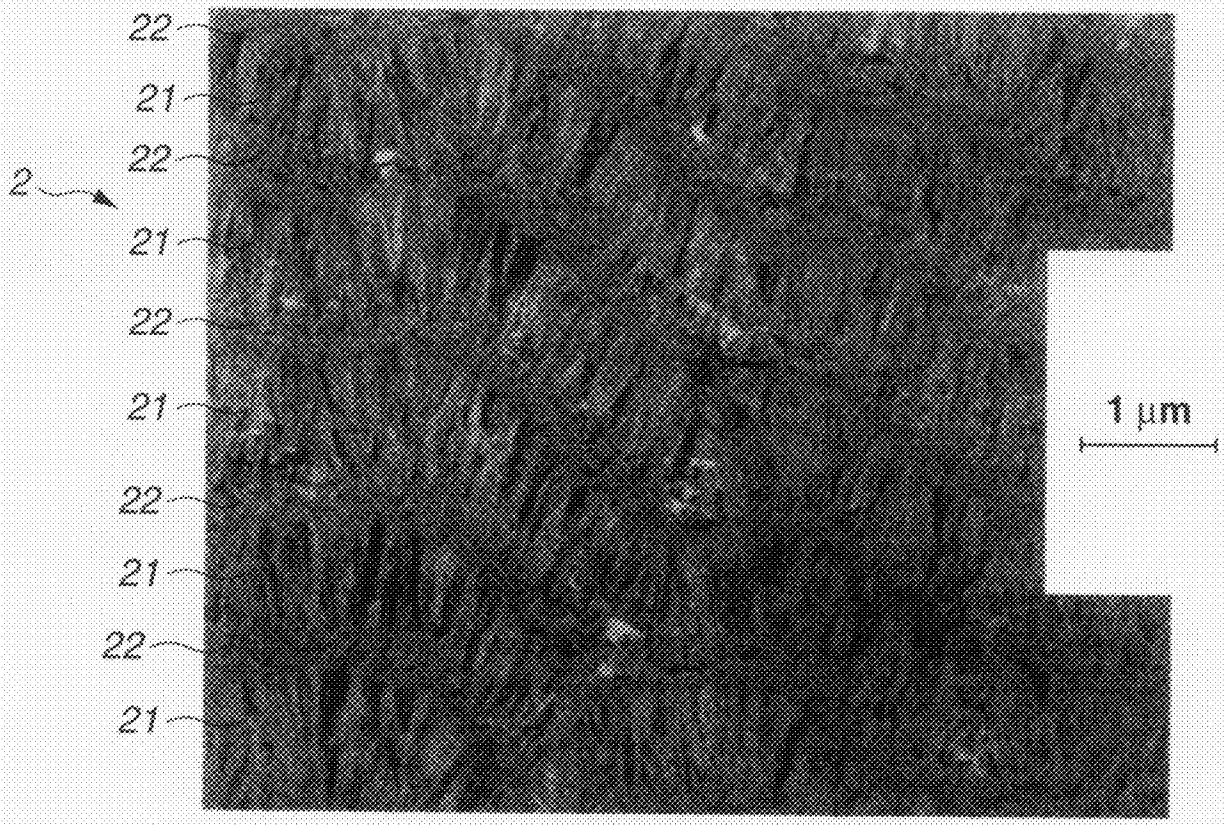
FIG. 3 is an electron micrograph showing the cross section of an aluminum nitride surface region of the aluminum composite material according to the first embodiment of the present invention.

An aluminum composite material according to a first embodiment of the present invention is produced by preparing an aluminum material 1 (as a base material) with a certain amount of silicon (Si) and magnesium (Mg), and then, plasma nitriding the aluminum material 1 to form a coating layer 2 of aluminum nitride (AlN) on a surface of the aluminum material 1 as shown in FIG. 2.

Figure 1A:
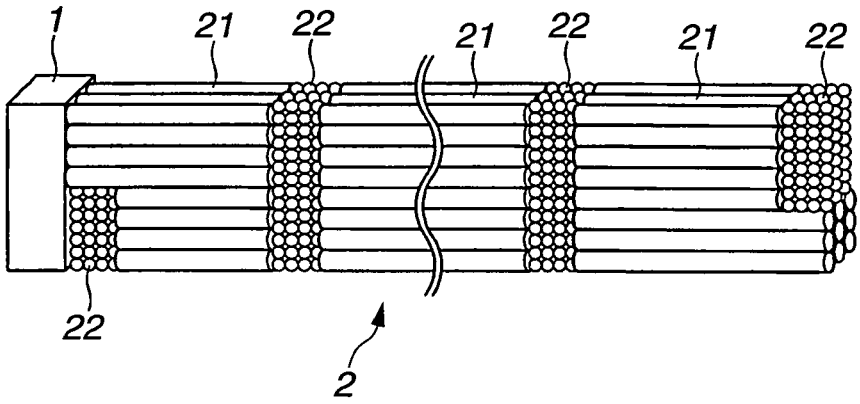
FIGS. 1A and 1B are schematic views showing structural examples of an aluminum composite material according to a first embodiment of the present invention.
Figure 1B:
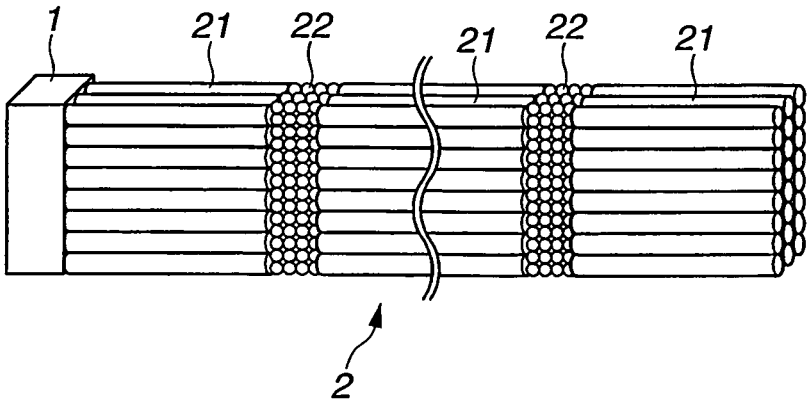

As shown in FIGS. 1A and 1B, the AlN layer 2 (as an aluminum nitride surface region) has a composite structure of alternating columnar structure units 21 and granular structure units 22 linked (polymerized) together.

Depending on the conditions of production of the aluminum composite material etc., the inner surface of the AlN layer 2 (in contact with the aluminum material 1) and the outer surface of the AlN layer 2 (opposite from the inner surface of the AlN layer 2) are formed by either or both of the columnar and granular structure units 21 and 22. For example, the columnar and granular structure units 21 and 22 may coexist at the inner and outer surfaces of the AlN layer 2 as shown in FIG. 1A. Only the columnar structure units 21 may exist at the inner and outer surfaces of the AlN layer 2 as shown in FIG. 1B. Although not shown in the drawings, only the granular structure units 22 may exist in the inner and outer surfaces of the AlN layer 2.

There is no particular restriction on the aluminum material 1 as long as the aluminum material 1 contains a certain amount of Si and Mg. The aluminum material 1 can be of any form, such as bulk form or powder form (with an average chip/particle diameter of about 1 mm to 1 μm), depending on the desired product form of the aluminum composite material.

The aluminum material 1 can be prepared by e.g. dissolving a certain amount of Si and Mg etc. in Al to yield a Si—Mg-containing Al alloy (such as Al—Si—Mg alloy), forging and/or rolling the Al alloy, and then, forming a supersaturated solid solution of the Al alloy at room temperature. The solid solution of the Al alloy can be formed by heating the Al alloy to a temperature higher than or equal to the melting points of the alloy elements such as Si and Mg but except Al (hereinafter just referred to as the "dissolved alloy elements") so as to cause sufficient supersaturation of the dissolved alloy elements and quenching the Al alloy at such a speed as not to cause crystallization of the dissolved alloy elements.

Alternatively, a commercially available Si—Mg-containing aluminum material can be used as the aluminum material 1. Specific examples of such a commercially available aluminum material are: "JIS 6061 Al alloy containing 0.4 to 0.8 mass % of Si and 0.8 to 1.2 mass % of Mg", "JIS ADC12 Al alloy containing 9.6 to 12.0 mass % of Si and less than 0.3 mass % of Mg" and "JIS AC4B Al alloy containing 7.0 to 10.0 mass % of Si and less than 0.5 mass % of Mg" as indicated in TABLE 1.

TABLE 1

| | Chemical composition (mass %) | | | | | | | | | | |
|---|---|---|---|---|---|---|---|---|---|---|---|
| | Si | Fe | Cu | Mn | Mg | Cr | Zn | Ti | Ni | Pb | Sn |
| ADC12Z | 9.6-12.0 | <1.3 | 1.5-3.5 | <0.5 | <0.3 | — | <3.0 | — | <0.5 | — | <0.3 |
| AC4B | 7.0-10.0 | <1.0 | 2.0-4.0 | <0.50 | <0.5 | <0.20 | <1.0 | <0.20 | <0.35 | <0.20 | <0.10 |
| AC8C | 8.5-10.5 | <1.0 | 2.0-4.0 | <0.50 | 0.50-1.5 | <0.10 | <0.50 | <0.20 | <0.50 | <0.10 | <0.10 |
| AC2A | 4.0-6.0 | <0.8 | 3.0-4.5 | <0.55 | <0.25 | <0.15 | <0.55 | <0.20 | <0.30 | <0.15 | <0.05 |
| 6061 | 0.40-0.8 | <0.7 | 0.15-0.4 | <0.15 | 0.8-1.2 | 0.04-0.35 | <0.25 | <0.15 | — | — | — |

In order to ensure the appropriate composite structure of the AlN layer 2 by plasma nitriding of the aluminum material 1, it is preferable that the aluminum material 1 contains 0.006 to 13.5 mass % of Si and 0.006 to 6.2 mass % of Mg.

Figure 8:
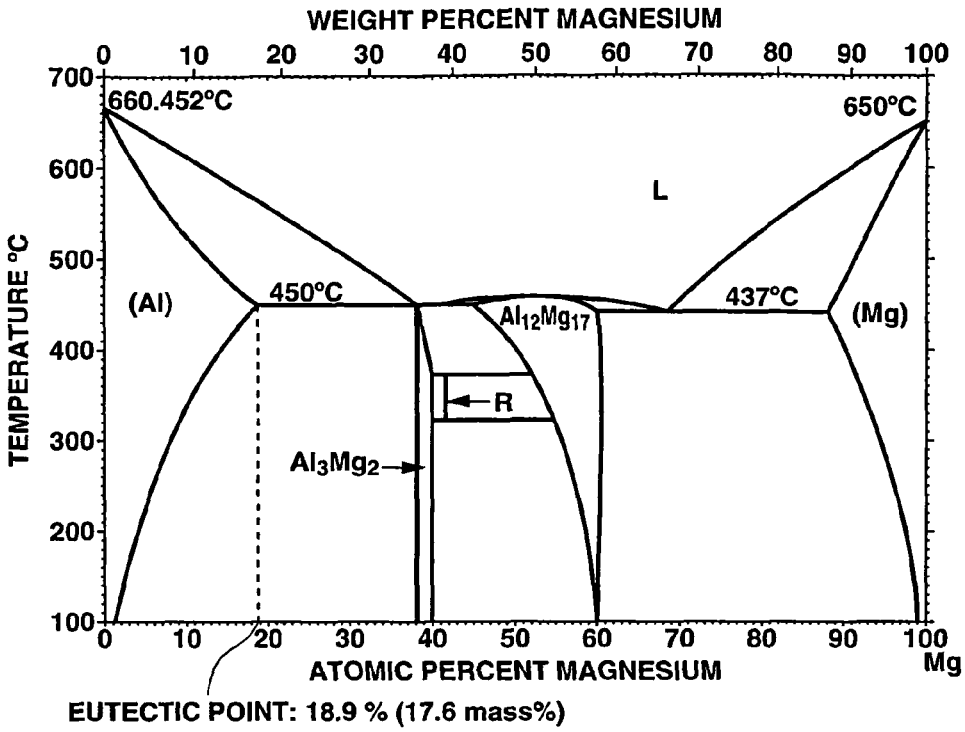
FIG. 8 is an equilibrium diagram of Al—Mg binary alloy.
Figure 9:
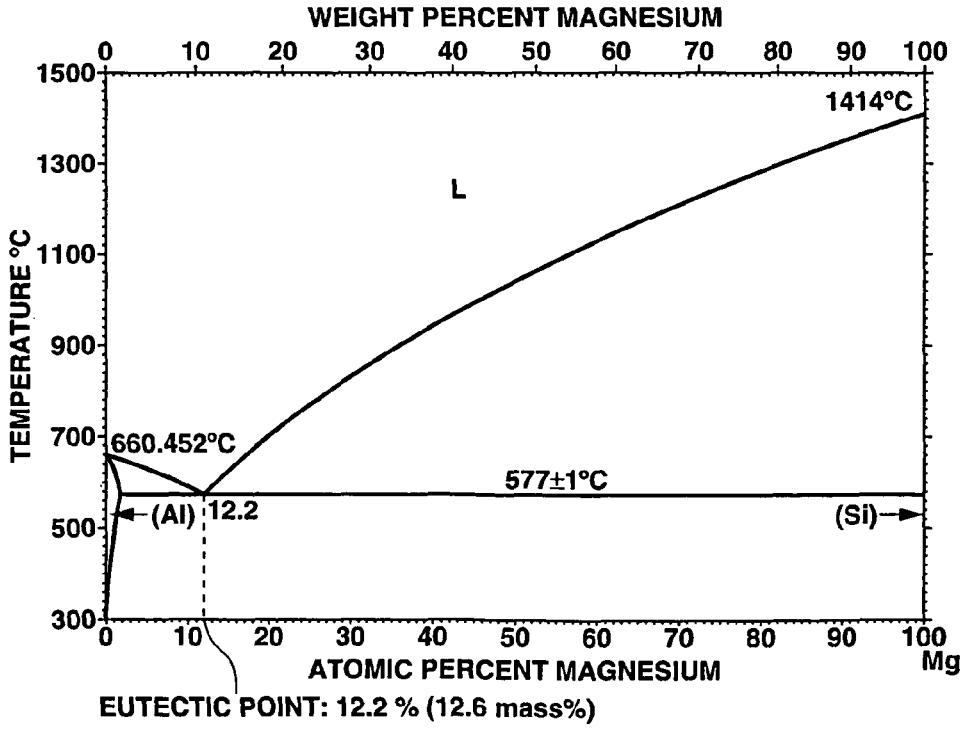
FIG. 9 is an equilibrium diagram of Al—Si binary alloy.

It is further preferable that the aluminum material 1 has a silicon-to-magnesium content ratio of Si/Mg=(A)/(D) to (G)/(F)=$5\times10^{-4}$ to $2.3\times10^{3}$, more preferably (E)/(H) to (C)/(D) =$1\times10^{-3}$ to $1\times10^{-1}$, where (A) to (D) are the solubility limits of Si and Mg in Al as indicated in TABLE 2; and (E) to (H) are the Si and Mg concentrations of the Al alloy as indicated in TABLE 3. Herein, the Si and Mg solubility limits (A) to (D) are read from Al—Si and Al—Mg alloy equilibrium diagrams of FIGS. 8 and 9. The Si and Mg concentrations (E) to (H) of the Al alloy are read from JIS Handbook "Non-ferrous metals & Metallurgy", PP966-975.

TABLE 2

| Element | Minimum solubility limit | Maximum solubility limit |
|---|---|---|
| Si | (A) 0.01 mass % (300° C.) | (C) 2 mass % (577° C.) |
| Mg | (B) 1.5 mass % (100° C.) | (D) 17 mass % (450° C.) |

TABLE 3

| Element | Minimum concentration (International Alloy No.) | Maximum concentration (International Alloy No.) |
|---|---|---|
| Si | (E) 0.006 (1199) | (G) 13.5 (4032) |
| Mg | (F) 0.006 (1199) | (H) 6.2 (5023) |

When the Mg concentration of the aluminum material 1 is in the above-specified range, Mg can be dissolved in and replace for Al. In practice, however, there is a possibility that a precipitate of $Mg_2Si$ occurs depending on the Si concentration of the aluminum material 1.

During the plasma nitriding, Si and Mg, which originally exist in solid solution or precipitate form, diffuse from inside the aluminum material 1 to outside and stop at the interface between the aluminum material 1 and the AlN layer 2 or continue diffusing to nucleate the growth of the columnar structure unit 21. After a specific diffusion span, some of Si and Mg stop and become agglomerated to nucleate the growth of the granular structure unit 22. By repeating this nitride growth mechanism, the columnar structure units 21 and granular structure units 22 are alternately linked (polymerized) together in the AlN layer 2. It is thus preferable that Si and Mg are dispersed with a certain degree of uniformity in the aluminum material 1.

In the first embodiment, JIS 6061 Al alloy is by way of example used as the aluminum material 1.

It is preferable to, before the plasma nitriding, surface treat the aluminum material 1 and thereby remove alumina ($Al_2O_3$) from the surface of the aluminum material 1. The $Al_2O_3$ removal treatment can be performed by any known technique such as reduction by a chlorine ion or sputtering e.g. argon ion sputtering.

In view of the correlation between the $Al_2O_3$ removal treatment and the subsequent plasma nitriding, the $Al_2O_3$ removal treatment is preferably performed by sputtering. In general, this presputtering treatment includes the steps of placing the aluminum material 1 in a sputtering chamber, evacuating the chamber and applying a continuous direct current voltage to the aluminum material 1, with the aluminum material 1 set as a cathode, for a given time in an atmosphere of chemically activated nitriding gas (hereinafter referred to as "sputtering gas").

The sputtering voltage is generally in the range of −100 to −1000 V, preferably −150 to −500 V.

The sputtering current density is generally in the range of 0.018 to 52.9 μA/mm$^2$, preferably 0.5 to 20 μA/mm$^2$. The minimum sputtering current density is herein determined to be 0.018 μA/mm$^2$ on the assumption that the natural oxidation film ($Al_2O_3$) having a density of 3.95 g/cm$^3$ and a thickness of 10 nm can be removed by presputtering for 1 hour. The maximum sputtering current density is determined to be 52.9 μA/mm$^2$ on the assumption that the natural oxidation film ($Al_2O_3$) having a density of 3.95 g/cm$^3$ and a thickness of 500 nm can be removed by presputtering for 1 minute.

The sputtering time is generally in the range of 10 minutes or more, preferably 10 to 60 minutes, more preferably 10 to 30 minutes.

The sputtering gas is preferably nitrogen gas ($N_2$ gas) or a mixture of $N_2$ gas and inert gas (e.g. Ar gas) and has a nitrogen partial pressure of 0.01 to 20 Torr, preferably 0.1 to 20 Torr, more preferably 0.1 to 5 Torr. In general, a high gas partial pressure does not allow high voltage application. It is thus desirable to control the gas partial pressure of the sputtering atmosphere in accordance with the sputtering voltage applied.

For example, the sputtering treatment can be performed under the following conditions.

| [Presputtering conditions] | |
|---|---|
| Direct current voltage: | −150 to −500 V |
| Current density: | 0.5 to 20 μA/mm$^2$ |
| Sputtering time: | 10 to 60 minutes |
| $N_2$ partial pressure: | 0.1 to 5.0 Torr |

The sputtering treatment may also enable aging (age hardening) of the aluminum material 1, e.g., apply $CuAl_2$ to the aluminum material 1, depending on the sputtering conditions such as sputtering temperature and/or time.

The plasma nitriding is preferably conducted at 300 to 600° C. for 1 hour or more.

It is particularly preferable to conduct the plasma nitriding by either of the following first and second plasma nitriding techniques. The first plasma nitriding technique includes applying a continuous direct current voltage to the aluminum material 1 in an atmosphere of activated nitriding gas (hereinafter referred to as "plasma nitriding gas"). The second plasma nitriding technique includes applying a pulsed direct current voltage to the aluminum material 1 for a given time in an atmosphere of activated nitriding gas (hereinafter also referred to as "plasma nitriding gas") and stopping the pulsed direct current voltage from being applied to the aluminum material 1 for a given time.

In the first embodiment, the plasma nitriding is conducted by the first plasma nitriding technique and, more specifically, by subjecting the aluminum material 1 to a continuous direct plasma glow discharge with a direct current voltage of −100 to −350 V and a current density of 0.5 to 20 μA/mm$^2$ for a given time in the plasma nitriding gas atmosphere.

The plasma nitriding time can be adjusted appropriately depending on the desired thickness of the AlN layer 2 and is generally 0.5 hour or more, e.g., 0.5 to 100 hours, preferably 1 to 25 hours, more preferably 4 to 9 hours, in order for the AlN layer 2 to be formed with a sufficient thickness.

The plasma nitriding gas is preferably either a gas consisting of nitrogen (N) and hydrogen (H) elements, such as ammonia ($NH_3$) gas, and/or a mixture of nitrogen gas ($N_2$ gas) and hydrogen gas ($H_2$ gas). Inert gas (e.g. Ar gas) may optionally be added to the nitriding gas. Preferably, the nitriding gas has a nitrogen partial pressure of 0.1 to 2.0 Torr and a hydrogen partial pressure of 0.3 to 6.0 Torr. In the first embodiment, a mixture of $N_2$ gas, $H_2$ gas and $NH_3$ gas is used as the nitriding gas with a $N_2$ partial pressure of 0.1 to 2.0 Torr, a $H_2$ partial pressure of 0.3 to 6.0 Torr and a $NH_3$ partial pressure of 0.02 to 20 Torr. It is further preferable that the nitrogen-to-hydrogen partial pressure ratio or nitrogen-to-hydrogen mole ratio of the plasma nitriding gas is 1:3. As discussed above, a high gas partial pressure does not allow high voltage application although a low gas partial pressure allows high voltage application for plasma generation. It is thus desirable to control the gas partial pressure of the plasma nitriding atmosphere in accordance with the plasma nitriding voltage applied.

Namely, the plasma nitriding can be conducted under the following conditions.

| [Plasma nitriding conditions] | |
|---|---|
| Temperature: | 300 to 600° C. |
| Time: | 4 to 9 hours |
| Direct current voltage: | −100 to −350 V |
| Current density: | 0.5 to 20 μA/mm$^2$ |
| $N_2$ partial pressure: | 0.1 to 2.0 Torr |
| $H_2$ partial pressure: | 0.3 to 6.0 Torr |
| $NH_3$ partial pressure: | 0.02 to 20 Torr |

By the above plasma nitriding technique, the AlN layer 2 grows at a rate of 0.05 μm/h or higher, preferably 0.5 to 100 μm/h. In particular, the growth rate of the AlN layer 2 is 10 to 13 μm/h at the initial stage of the plasma nitriding (until 4 hours after the initiation of the plasma nitriding) and 10 to 30 μm/h at the subsequent stage of the plasma nitriding (4 to 6 hours after the initiation of the plasma nitriding).

The thickness of the AlN layer 2 can be controlled by varying the conditions of production of the alumina composite material, especially the plasma nitriding conditions such as nitriding time, and is generally on the order of micrometers, e.g., 0.01 μm or larger, preferably 0.5 μm or larger, more preferably 2 to 2000 μm or larger, still more preferably 4 to 200 μm. Further, the ratio of the thickness of the columnar structure units 21 to the thickness of the granular structure units 22 in the AlN layer 2 is preferably in the range of 0.1 to 0.3.

The thus-formed AlN layer 2 attains such a multilayer composite structure that the columnar structure units 21 and granular structure units 22 are alternately linked (polymerized) together as explained above.

The columnar structure units 21 are closely packed, with a high concentration of nitrogen (N) dispersed therethrough, and show high hardness and deformation resistance so as to provide protection against external force. On the other hand, the granular structure units 22 are softer than the columnar structure units 21 and show high toughness so as to absorb impact from any direction. With the novel multilayer composite structure of these alternating columnar and granular structure units 21 and 22, the AlN layer 2 secures both of high wear and impact resistance.

As the granular structure units 22 allow strong adhesion between any two adjacent columnar structure units 21, the AlN layer 2 substantially increases in durability even when formed with a large thickness.

The inner part of the AlN layer 2 (i.e. some of the columnar and granular structure units 21 and 22 located on the side of the aluminum material 1) can be protected from wear or break so as to inhibit the development of a crack in the AlN layer 2 even in the event that the outer part of the AlN layer 2 becomes worn or broken by external force etc. The AlN layer 2 thus maintains the same deformation resistance and impact absorption properties and obtains improvements in crack resistance and compressive stress relaxation capability.

In this way, the AlN layer 2 is able to attain high durability and provide high protection to the aluminum material 1 over a long-time use.

The distribution of aluminum (Al), nitrogen (N), oxygen (O), magnesium (Mg) and silicon (Si) elements in the aluminum composite material is seen from electron micrograph images of FIGS. 4A to 4E and 5A to 5E. The respective element concentrations are herein colored in monochrome in FIGS. 4A to 4E and 5A to 5E although originally color-coded from red for "high concentration" down through the color spectrum to blue for "low concentration" and black for "zero concentration (no existence)".

Figure 4A:
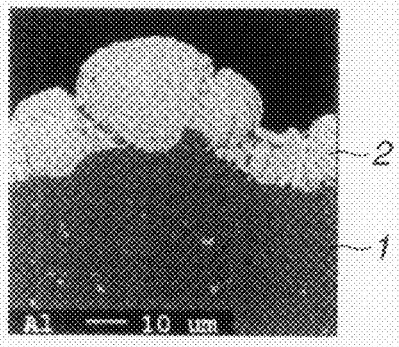
FIGS. 4A to 4E are electron micrographs showing the distributions of aluminum, nitrogen, oxygen, magnesium and silicon in the aluminum composite material according to the first embodiment of the present invention.
Figure 4D:
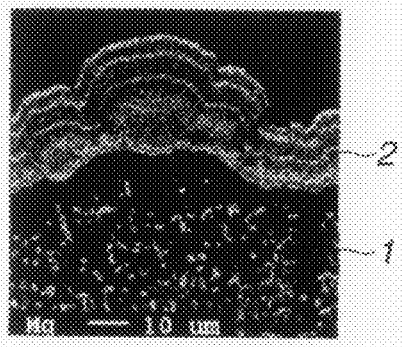
Figure 5A:
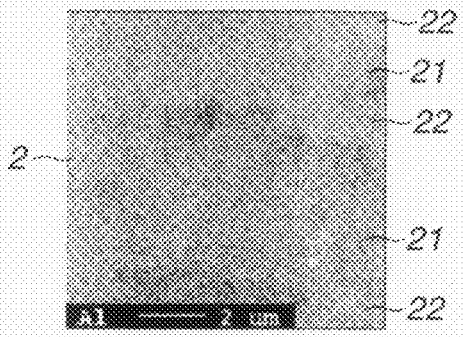
FIGS. 5A to 5E are electron micrographs showing the distributions of aluminum, nitrogen, oxygen, magnesium and silicon in the aluminum nitride surface region of the aluminum composite material according to the first embodiment of the present invention.
Figure 5D:
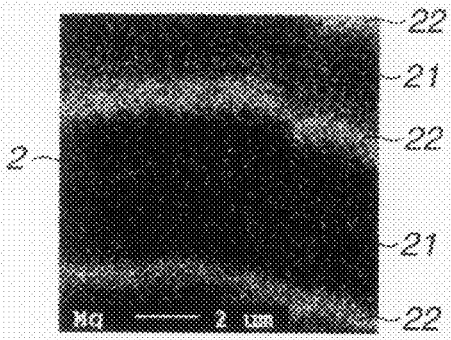

As shown in FIG. 4A, Al exists at a high concentration in the aluminum material 1. Further, Al exists in the AlN layer 2 with slight concentration variations and, more specifically, at a higher concentration in the columnar structural units 21 than in the granular structure units 22 as shown in FIGS. 4A and 5A.

Figure 4B:
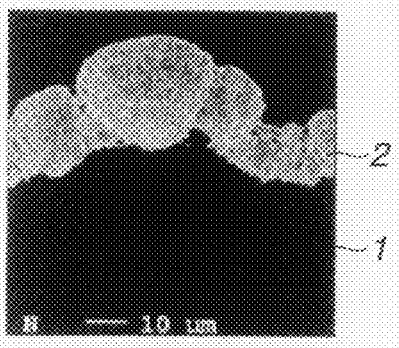
Figure 4E:
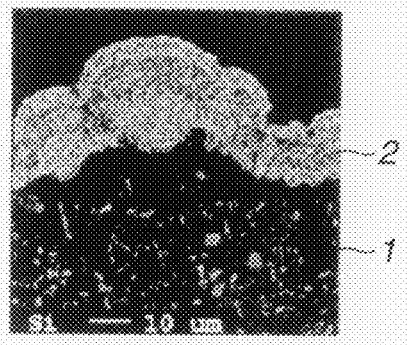
Figure 5B:
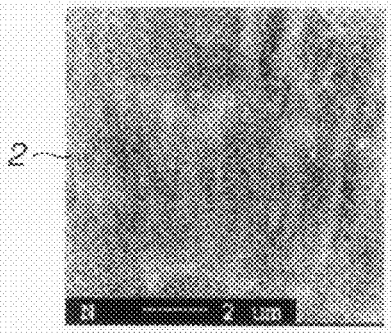
Figure 5E:
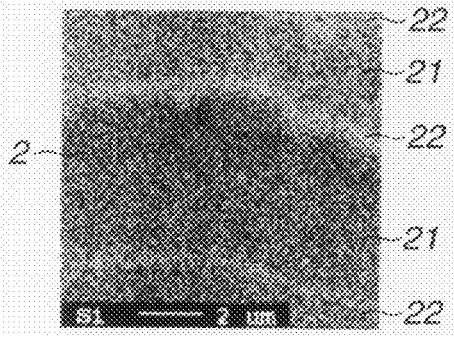

There is almost no N in the aluminum material 1 as shown in FIG. 4B. By contrast, N is finely dispersed in the AlN layer 2 with some concentration variations as shown in FIGS. 4B and 5B.

Figure 4C:
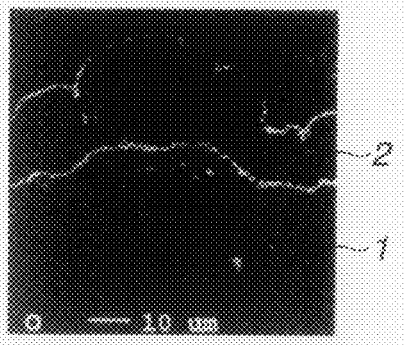
Figure 5C:
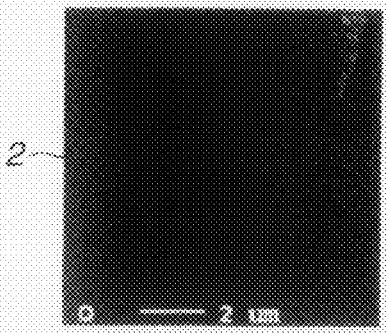

There is almost no O inside the aluminum material 1 and the AlN layer 2 but a slight amount of O at around the interface between the aluminum material 1 and the AlN layer 2 and at the outer surface of the AlN layer 2 as shown in FIGS. 4C and 5C.

Both of Mg and Si are finely dispersed in the aluminum material 1 and the AlN layer 2 as shown in FIGS. 4D, 4E, 5D and 5E. In particular, Mg and Si exist at high concentrations at the interface between the aluminum material 1 and the AlN layer 2 and at the outer surface of the AlN layer 2. Both of Mg and Si also increase in concentration at substantially the same positions (at intervals of about 6 μm in the first embodiment) within the AlN layer 2, i.e., exist at lower concentrations in the columnar structure units 21 and at higher concentrations in or around the granular structure units 22. By contrast, Mg and Si exist in the aluminum material 1 at very low concentrations within a given depth (10 μm in the first embodiment) below the interface between the aluminum material 1 and the AlN layer 2 and are uniformly dispersed at the given depth or greater from the interface between the aluminum material 1 and the AlN layer 2.

The above element distribution verifies the nitride growth mechanism in which Si and Mg contribute to the multilayer composite structure of the AlN layer. The growth mechanism of the AlN layer 2 is further considered as follows.

The aluminum material 1 generally contains not only Si and Mg, but copper (Cu), zinc (Zn), iron (Fe), chromium (Cr), nickel (Ni), tin (Sn) and lead (Pb) as main elements. As is seen from TABLE 1, almost no Fe, Cr, Ni and Sn are dissolved in and replace for Al although the solubility limits of Si, Mg, Cu and Zn in Al are relatively large. Except for Pb, Sn and Zn, there are few alloy elements that can inhibit growth of the AlN layer 2.

It is known that Si is difficult to nitride directly to $Si_3N_4$. In the case of general aluminum alloy casting (such as JIS AC2A, AC4B, AC8C or ADC12 aluminum alloy) having a Si content of 4 mass % or higher, initial crystal Si exist on the surface of the aluminum alloy so that there will be a difficulty in nitriding such initial crystal Si.

It is further desired that the aluminum alloy is treated by nitriding at a certain temperature range e.g. 550° C. or lower in view of the melting point of the alloy material.

Herein, Preprints of National Meeting of Japan Welding Society, No. 19, Pages 368-369 (1976) provides a report that the rate of diffusion of Si in Al at 540° C. is about $1.8\times10^{-9}$ $cm^2/s$, which means that the average diffusion distance of Si in Al at 540° C. for 4 hours is 515 μm.

In view of the foregoing, it is assumed that, when the plasma nitriding treatment is conducted under the above conditions, Si can be diffused sufficiently through the AlN layer 2 so as to allow a uniform concentration distribution of Si in the AlN layer 2 unless Si precipitates as a nitride. The same goes for the other alloy elements including Mg.

In practice, however, the Si and Mg concentrations increase at substantially the same positions in the AlN layer 2 as discussed above even though no nitrides of Si and Mg are detected by X-ray diffraction. The N concentration does not show such one-dimensional regularity but decreases relative to increases in Si and Mg concentrations. It is thus concluded that Si and Mg are dissolved in and replace for Al in the AlN layer 2, or exist as hardly-detectable nano-sized Si—Al—O—N compound by alloying of $Si_3N_4$ with Mg, Al and O.

Second and Third Embodiments

Aluminum composite materials according to second and third embodiments of the present invention are similar to that of the first embodiment, except for the composition of the aluminum material 1 and the production conditions of the aluminum composite material as follows.

There is a possibility that the AlN layer 2 may not be easily formed with appropriate composite structure of alternating columnar and granular structural units 21 and 22 by the first plasma nitriding technique in the case of some kinds of aluminum material 1, especially not having a chemical composition equivalent or close to that of JIS 6061 Al alloy. In other word, in the case where the plasma nitriding is conducted by the first plasma nitriding technique, it is preferable that the aluminum material 1 contains 0.2 to 1.8 mass % of Si and 0.2 to 1.6 mass % Mg and has a Si/Mg content ratio of (I)/(L) to (K)/(J)=0.12 to 10 in order to easily and assuredly form the AlN layer 2 with appropriate composite structure of alternating columnar and granular structural units 21 and 22. Herein, (I) to (L) are the Si and Mg concentrations of the aluminum alloy as indicated in TABLE 4, which are read from the aluminum alloy composition data of International alloy number 6000 series in JIS Handbook "Non-ferrous metals & Metallurgy" PP 966-975.

TABLE 4

| Element | Minimum concentration (International Alloy No.) | Maximum concentration (International Alloy No.) |
|---|---|---|
| Si | (I) 0.2 (6066, 6306, 6015, 6951, 6063, 6463, 6463A, 6763) | (K) 1.8 (6066) |
| Mg | (J) 0.2 (6016A, X6022) | (L) 1.6 (6069) |

When the Mg concentration of the aluminum material 1 is in the above-specified range, Mg can be dissolved in and replace for Al. In practice, however, there is a possibility that a precipitate of $Mg_2Si$ occurs depending on the Si concentration of the aluminum material 1.

On the other hand, the AlN layer 2 can be formed easily and assuredly with appropriate composite structure of alternating columnar and granular structural units 21 and 22 by the second plasma nitriding technique as long as the aluminum material 1 contains 0.006 to 13.5 mass % of Si and 0.006 to 6.2 mass % of Mg.

In the second embodiment, JIS ADC12 aluminum alloy (substantially equivalent to JIS ADC12Z aluminum alloy) is used as the aluminum material 1. In the third embodiment, JIS AC4B aluminum alloy is used as the aluminum material 1.

In this case, the $Al_2O_3$ removal presputtering treatment can be performed, for improvement in presputtering efficiency, by applying a continuous direct current voltage of −100 to −1000V, preferably −150 to −1000V, to the aluminum material 1, with the aluminum material 1 set as a cathode, for 10 minutes or more, preferably 10 to 60 minutes, more preferably 10 to 30 minutes, in an atmosphere of chemically activated nitriding gas atmosphere with a nitrogen partial pressure of 0.01 to 20 Torr, more preferably 0.01 to 10 Torr.

The other presputtering treatment conditions of the second embodiment are the same as those of the first embodiment.

Further, the plasma nitriding is conducted by the second plasma nitriding technique and, more specifically, by repeated cycles of applying a pulsed direct current voltage of −100 to −50 kV, preferably −200 to −1000 V, to the aluminum material 1 for 0.05 μsec to 1 sec, preferably 10 to 1000 μsec, in an atmosphere of activated nitriding gas, with the aluminum material 1 set as a cathode, and stopping the pulsed direct current voltage from being applied to the aluminum material for 0.05 μsec to 1 sec, preferably 10 to 1000 μsec in the second embodiment.

The total plasma nitriding time can be adjusted appropriately depending on the desired thickness of the AlN layer 2 and is generally 0.5 hour or more, e.g., 0.5 to 100 hours, preferably 1 hour or more, more preferably 1 to 25 hours, still more preferably 4 to 9 hours, in order for the AlN layer 2 to be formed with a sufficient thickness.

The other plasma nitriding conditions of the second embodiment are the same as those of the first embodiment.

For example, the plasma nitriding can be conducted under the following conditions.

[Plasma nitriding conditions]

| | |
|---|---|
| Temperature: | 300 to 600° C. |
| Nitriding time: | 4 to 9 hours |
| Direct current voltage: | −100 to −350 V |
| Current density: | 0.5 to 20 μA/mm$^2$ |
| $N_2$ partial pressure: | 0.01 to 2.0 Torr |
| $H_2$ partial pressure: | 0.3 to 6.0 Torr |
| $NH_3$ partial pressure: | 0.02 to 20 Torr |

The application of the high pulsed voltage and the selection of the appropriate pulse conditions lead to higher N2+ ion energy so as to obtain an improvement in nitriding efficiency. If the total gas pressure is high, however, the plasma discharge may be readily shifted to arc discharge to cause a momentary drop in voltage but increase in current so that the material becomes melted or vaporized. For this reason, it is desirable to decrease the voltage application time and the total gas pressure as the application voltage increases.

Figure 6:
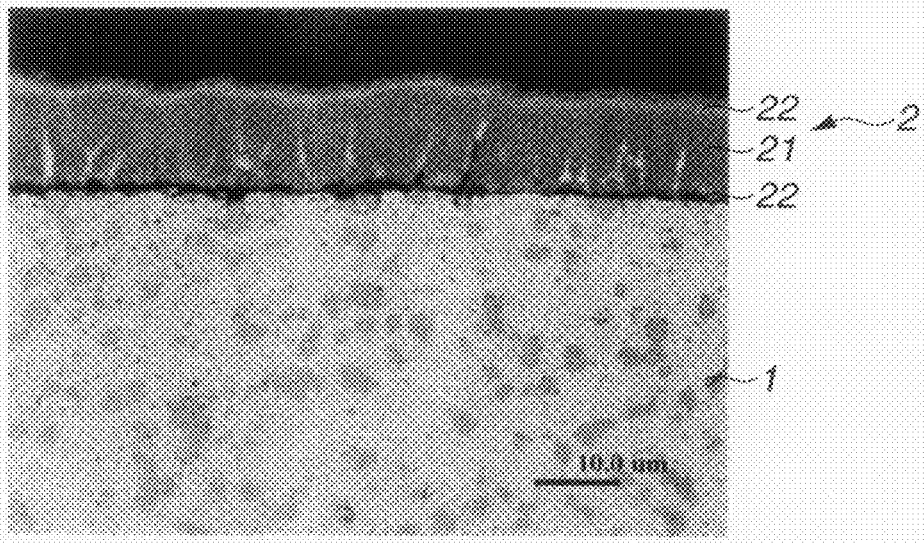
FIG. 6 is an electron micrograph of an aluminum composite material according to a second embodiment of the present invention.
Figure 7:
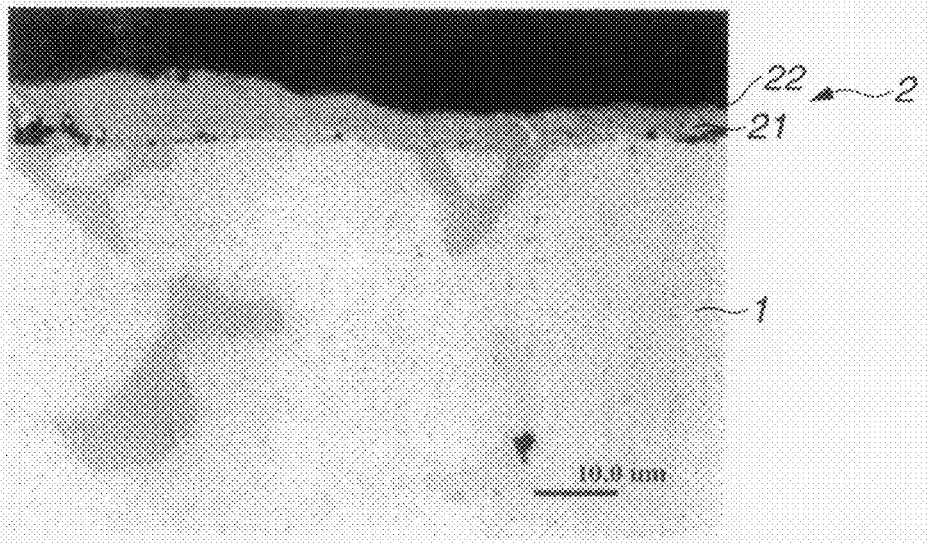
FIG. 7 is an electron micrograph of an aluminum composite material according to a third embodiment of the present invention.

By the above plasma nitriding technique, the AlN layer 2 also attains such a multilayer composite structure that the composite structure of the columnar and granular structural units 21 and 22 linked (polymerized) together as shown in FIGS. 6 and 7 although the number of the layered structural units 21 and 22 is smaller in the second and third embodiments. The AlN layer 2 thus provides high protection for the aluminum material 1.

The entire contents of Japanese Patent Application No. 2007-008113 (filed on Jan. 17, 2007) are herein incorporated by reference.

Although the present invention has been described with reference to the above-specific embodiments of the invention, the invention is not limited to these exemplary embodiments. Various modification and variation of the embodiments described above will occur to those skilled in the art in light of the above teachings. For example, the aluminum material 1 is not limited to JIS 6061 Al alloy, JIS ADC12 Al alloy or JIS AC4B Al alloy although these aluminum alloys are used as the aluminum material 1 in the first, second and third embodiments. Any other aluminum alloy is usable. It is however considered that the AlN layer 2 can be formed more readily and assuredly by the first plasma nitriding technique as discussed above when the aluminum material 1 has a chemical composition equivalent or close to that of JIS 6061 Al alloy (i.e. when the aluminum material 1 contains 0.2 to 1.8 mass % of Si and 0.2 to 1.6 mass % Mg). The second plasma nitriding technique can suitably be applied to a wider variety of the aluminum material 1. The scope of the invention is defined with reference to the following claims.

What is claimed is:

1. An aluminum surface treatment process, comprising:

preparing an aluminum material that contains 7.0 to 12.0% by mass of silicon and less than 1.5% by mass of magnesium;

plasma nitriding the aluminum material to form an aluminum nitride region on a surface of the aluminum material, the plasma nitriding comprising:

applying a pulsed direct current voltage of −200 to −1000 V to the aluminum material for 10 to 1000 μs in an atmosphere of activated nitriding gas; and stopping the pulsed direct voltage from being applied to the aluminum material for 10 to 1000 μs; and sputtering the aluminum material, before the plasma nitriding, to remove alumina from the surface of the aluminum material, wherein a sputtering current density is 0.018 to 52.9 μA/mm$^2$, wherein the aluminum nitride region has a composite structure of alternating columnar and granular structure units linked together, wherein an inner surface of the aluminum nitride region in contact with the aluminum material comprises a columnar structure unit, a granular structure unit or a combination thereof, and wherein an outer surface of the aluminum nitride region, opposite from the inner surface of the aluminum nitride region, comprises a columnar structure unit, a granular structure unit or a combination thereof.

2. The aluminum surface treatment process according to claim 1, wherein the plasma nitriding is conducted at 300 to 600° C. for 1 hour or more.

3. The aluminum surface treatment process according to claim 2, wherein the nitriding gas of the plasma nitriding is a gas consisting of nitrogen and hydrogen elements and/or mixture of nitrogen gas and hydrogen gas.

4. The aluminum surface treatment process according to claim 3, wherein the nitriding gas has a nitrogen partial pressure of 0.1 to 2.0 Torr and a hydrogen partial pressure of 0.3 to 6.0 Torr.

5. The aluminum surface treatment process according to claim 1, wherein the sputtering is performed by applying a direct current voltage of −100 to −1000 V to the aluminum material, with the aluminum material set as a cathode, for 10 minutes or more in an atmosphere of chemically activated nitriding gas having a nitrogen partial pressure of 0.01 to 20 Torr.

* * * * *